US011933532B2

(12) United States Patent
Shi et al.

(10) Patent No.: US 11,933,532 B2
(45) Date of Patent: Mar. 19, 2024

(54) DRIVE BAR FOR ICE BIN OF ICE MAKER

(71) Applicant: Electrolux Home Products, Inc., Charlotte, NC (US)

(72) Inventors: Zhuochen Shi, Clemson, SC (US); Marcelo C. Candeo, Piedmont, SC (US); Lokesha Kodigenahalli Chinnappa Reddy, Anderson, SC (US); Thomas McCollough, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 319 days.

(21) Appl. No.: 17/371,659

(22) Filed: Jul. 9, 2021

(65) Prior Publication Data

US 2023/0010817 A1 Jan. 12, 2023

(51) Int. Cl.
*F25C 5/20* (2018.01)

(52) U.S. Cl.
CPC ..... *F25C 5/24* (2018.01); *F25C 5/22* (2018.01); *F25C 2400/10* (2013.01)

(58) Field of Classification Search
CPC ..... F25C 5/24; F25C 5/22; F25C 5/18
See application file for complete search history.

(56) References Cited

U.S. PATENT DOCUMENTS 8,402,783 B2 3/2013 Kim et al.
8,555,658 B2 10/2013 Kim et al.
9,074,804 B2 7/2015 Yoon
9,080,799 B2 7/2015 Hong et al.
9,234,690 B2 1/2016 McCollough
9,273,892 B2 3/2016 Lee
10,036,585 B2 7/2018 McCollough
10,126,037 B2 11/2018 Barrena et al.
10,190,810 B2 1/2019 Ramirez, Jr.
10,527,335 B2 1/2020 Bertolini et al.
10,819,193 B2 10/2020 Saito
2013/0192279 A1* 8/2013 McCollough ..... F25C 1/12 62/344
2018/0328642 A1 11/2018 McCollough
2019/0011166 A1* 1/2019 Bertolini ..... F25C 5/22
2019/0041112 A1 2/2019 Chatelle et al.
2019/0068031 A1 2/2019 Saito

* cited by examiner

*Primary Examiner* — Elizabeth J Martin

(74) *Attorney, Agent, or Firm* — Pearne & Gordon LLP

(57) ABSTRACT

A refrigeration appliance includes a fresh food compartment and a freezer compartment. An ice maker is disposed within the fresh food compartment for freezing water into ice pieces. The ice maker includes a removable ice bin for storing the ice pieces produced by the ice maker. A rotatable auger is positioned within the removable ice bin and configured to drive the ice pieces out of the removable ice bin via a driving force applied in a first direction. A motor is configured to rotate the auger. A drive bar is coupled to the motor and is configured to apply a resisting force to the removable ice bin along a second direction generally opposed to the first direction sufficient to counteract the driving force, wherein the resisting force is less than a removal force applied by a user to remove the removable ice bin from the ice maker.

11 Claims, 11 Drawing Sheets

DRIVE BAR FOR ICE BIN OF ICE MAKER

FIELD OF THE INVENTION

This application relates generally to an ice maker for a refrigeration appliance, and more particularly, to a refrigeration appliance including an ice maker disposed within a food-storage compartment of a refrigerator that is maintained at a temperature above a freezing temperature of water at atmospheric conditions, and an auger for dispensing ice from the ice maker.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C. and the freezer compartments at temperatures below 0° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

Such conventional refrigerators are often provided with a unit for making ice pieces, commonly referred to as "ice cubes" despite the non-cubical shape of many such ice pieces. These ice making units may be located in the freezer compartment or the fresh food compartment of the refrigerator and manufacture ice by convection, i.e., by circulating cold air over water in an ice tray to freeze the water into ice cubes. Storage bins for storing the frozen ice pieces are also often provided adjacent to the ice making units. The ice pieces can be dispensed from the storage bins through a dispensing port in the door that closes the freezer compartment or the fresh food compartment to the ambient air. The dispensing of the ice usually occurs by means of an ice delivery mechanism that extends between the storage bin and the dispensing port in the freezer compartment door.

The ice delivery mechanism often includes an auger that, when rotated, conveys the ice cubes to the dispensing port. Due to the forces generated by the auger during ice delivery, a complex arrangement of latches is often required to retain the storage bin in the compartment during ice dispensing.

Accordingly, there is a need in the art for a refrigerator including an ice maker disposed within a compartment of the refrigerator in which a complex arrangement of latches is not required to retain the ice storage bin within the ice maker during an ice dispensing process.

BRIEF SUMMARY OF THE INVENTION

In accordance with one aspect, there is provided a refrigeration appliance that includes a fresh food compartment for storing food items in a refrigerated environment having a target temperature above zero degrees Centigrade. A freezer compartment stores food items in a sub-freezing environment having a target temperature below zero degrees Centigrade. An ice maker is disposed within the fresh food compartment or the freezer compartment for freezing water into ice pieces. The ice maker includes a removable ice bin for storing the ice pieces produced by the ice maker. A rotatable auger is positioned within the removable ice bin and configured to drive the ice pieces out of the removable ice bin via a driving force applied in a first direction. A motor is configured to rotate the auger. A drive bar is coupled to the motor and is configured to apply a resisting force to the removable ice bin along a second direction generally opposed to the first direction sufficient to counteract the driving force, wherein the resisting force is less than a removal force applied by a user to remove the removable ice bin from the ice maker.

In the refrigeration appliance, the drive bar may include at least one leg having a recess formed in a surface thereof for engaging the rotatable auger.

In the refrigeration appliance, the drive bar may include at least one leg having a chamfered surface for engaging the rotatable auger.

In the refrigeration appliance, the drive bar may include at least one leg with an engagement surface for engaging the rotatable auger during insertion of the removable ice bin into the ice maker.

In the refrigeration appliance, a cam may be disposed between the rotatable auger and the drive bar and the cam may include a slot in a side wall thereof for receiving a distal end of the rotatable auger.

In the foregoing refrigeration appliance, the drive bar may include at least one leg with an engagement surface for engaging a protrusion formed on an inner wall of the cam during insertion of the removable ice bin into the ice maker.

In the refrigeration appliance, the drive bar may include a U-shaped body having two legs. Each of the two legs may include a recess formed in a surface thereof for engaging the rotatable auger.

In the refrigeration appliance, the drive bar may include a U-shaped body having two legs. Each of the two legs may include a chamfered surface for engaging the rotatable auger.

In the refrigeration appliance, the at least one leg of the drive bar may provide the resisting force sufficient to counteract the driving force of the rotatable auger.

In the refrigeration appliance, the freezer compartment may be disposed at an elevation vertically below the fresh food compartment.

In the refrigeration appliance, the freezer compartment may be disposed laterally next to the fresh food compartment.

DESCRIPTION OF EXAMPLE EMBODIMENTS

Figure 1:
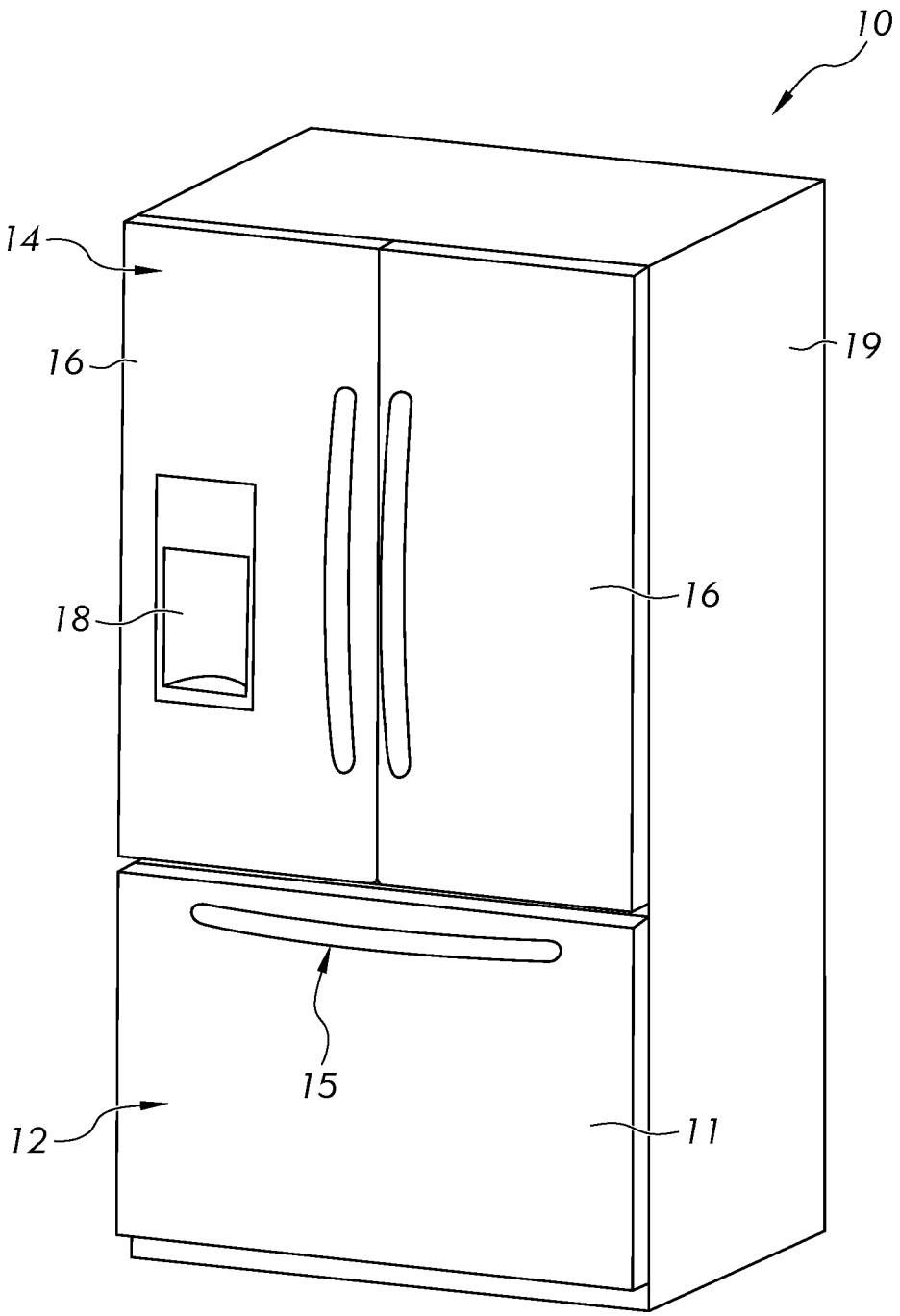
FIG. 1 is a front perspective view of a household French Door Bottom Mount showing doors of the refrigerator in a closed position.
Figure 2:
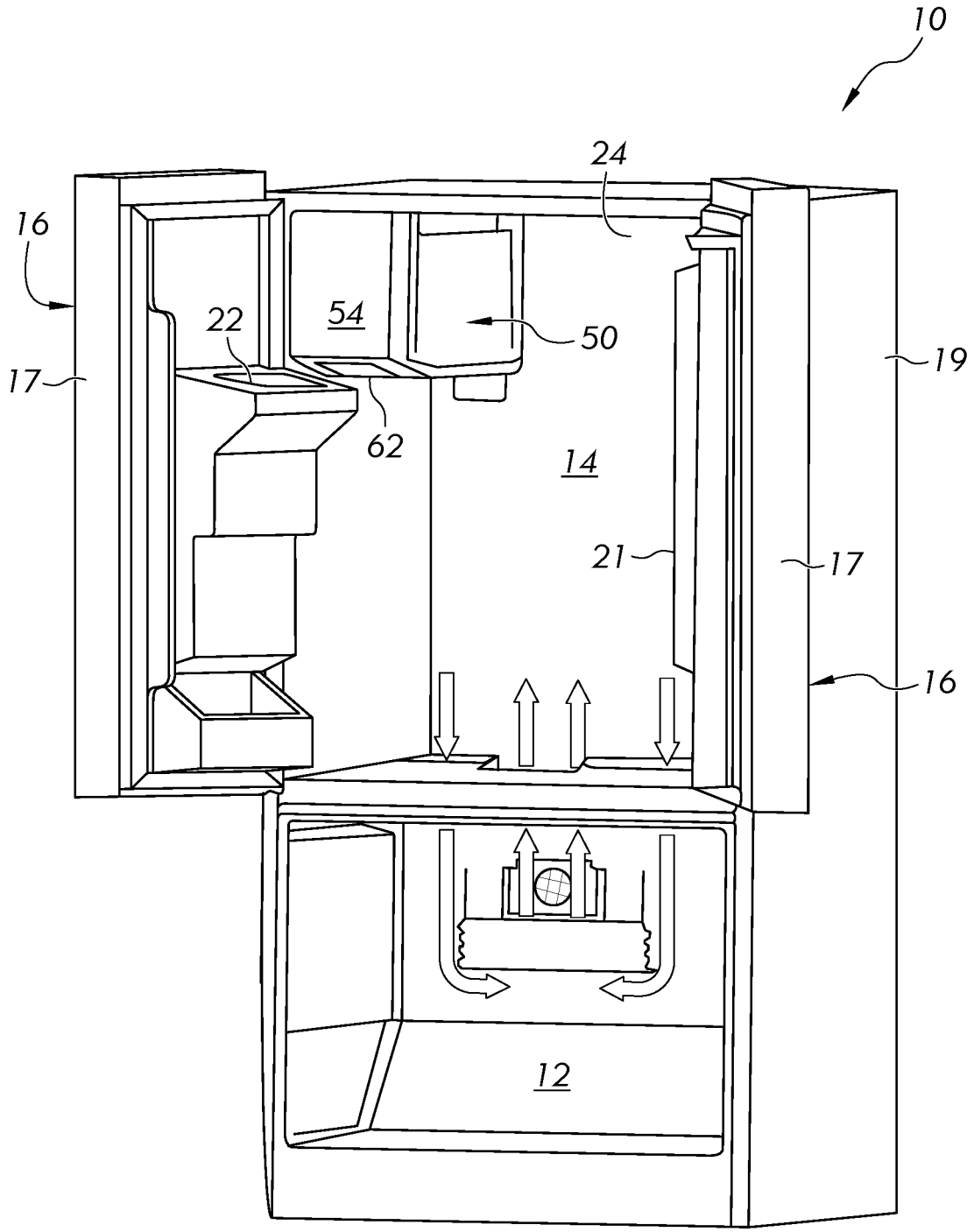
FIG. 2 is a front perspective view of the refrigerator of FIG. 1 showing the doors in an open position and an ice maker in a fresh food compartment.

Referring now to the drawings, FIG. 1 shows a refrigeration appliance in the form of a domestic refrigerator, indicated generally at 10. Although the detailed description that follows concerns a domestic refrigerator 10, the invention can be embodied by refrigeration appliances other than with a domestic refrigerator 10. Further, an embodiment is described in detail below, and shown in the figures as a bottom-mount configuration of a refrigerator 10, including a fresh food compartment 14 disposed vertically above a freezer compartment 12. However, the refrigerator 10 can have any desired configuration including at least a fresh food compartment 14 and an ice maker 50 (FIG. 2), such as a top mount refrigerator (freezer disposed above the fresh food compartment), a side-by-side refrigerator (fresh food compartment is laterally next to the freezer compartment), a standalone refrigerator or freezer, etc.

One or more doors 16 shown in FIG. 1 are pivotally coupled to a cabinet 19 of the refrigerator 10 to restrict and grant access to the fresh food compartment 14. The door 16 can include a single door that spans the entire lateral distance across the entrance to the fresh food compartment 14, or can include a pair of French-type doors 16 as shown in FIG. 1 that collectively span the entire lateral distance of the entrance to the fresh food compartment 14 to enclose the fresh food compartment 14. For the latter configuration, a center flip mullion 21 (FIG. 2) is pivotally coupled to at least one of the doors 16 to establish a surface against which a seal provided to the other one of the doors 16 can seal the entrance to the fresh food compartment 14 at a location between opposing side surfaces 17 (FIG. 2) of the doors 16. The mullion 21 can be pivotally coupled to the door 16 to pivot between a first orientation that is substantially parallel to a planar surface of the door 16 when the door 16 is closed, and a different orientation when the door 16 is opened. The externally-exposed surface of the center mullion 21 is substantially parallel to the door 16 when the center mullion 21 is in the first orientation, and forms an angle other than parallel relative to the door 16 when the center mullion 21 is in the second orientation. The seal and the externally-exposed surface of the mullion 21 cooperate approximately midway between the lateral sides of the fresh food compartment 14.

A dispenser 18 (FIG. 1) for dispensing at least ice pieces, and optionally water, can be provided on an exterior of one of the doors 16 that restricts access to the fresh food compartment 14. The dispenser 18 includes a lever, switch, proximity sensor or other device that a user can interact with to cause frozen ice pieces to be dispensed from an ice bin 54 (FIG. 2) of the ice maker 50 disposed within the fresh food compartment 14. Ice pieces from the ice bin 54 can be delivered to the dispenser 18 via an ice chute 22 (FIG. 2), which extends at least partially through the door 16 between the dispenser 18 and the ice bin 54.

Referring to FIG. 1, the freezer compartment 12 is arranged vertically beneath the fresh food compartment 14. A drawer assembly (not shown) including one or more freezer baskets (not shown) can be withdrawn from the freezer compartment 12 to grant a user access to food items stored in the freezer compartment 12. The drawer assembly can be coupled to a freezer door 11 that includes a handle 15. When a user grasps the handle 15 and pulls the freezer door 11 open, at least one or more of the freezer baskets is caused to be at least partially withdrawn from the freezer compartment 12.

The freezer compartment 12 is used to freeze and/or maintain articles of food stored in the freezer compartment 12 in a frozen condition. For this purpose, the freezer compartment 12 is in thermal communication with a freezer evaporator (not shown) that removes thermal energy from the freezer compartment 12 to maintain the temperature therein at a temperature of 0° C. or less during operation of the refrigerator 10.

The refrigerator 10 includes an interior liner 24 (FIG. 2) that defines the fresh food compartment 14. The fresh food compartment 14 is located in the upper portion of the refrigerator 10 in this example and serves to minimize spoiling of articles of food stored therein. The fresh food compartment 14 accomplishes this by maintaining the temperature in the fresh food compartment 14 at a cool temperature that is typically less than an ambient temperature of the refrigerator 10, but somewhat above 0° C., so as not to freeze the articles of food in the fresh food compartment 14. According to some embodiments, cool air from which thermal energy has been removed by the freezer evaporator can also be blown into the fresh food compartment 14 to maintain the temperature therein at a cool temperature that is greater than 0° C. For alternate embodiments, a separate fresh food evaporator can optionally be dedicated to separately maintaining the temperature within the fresh food compartment 14 independent of the freezer compartment 12. According to an embodiment, the temperature in the fresh food compartment 14 can be maintained at a cool temperature within a close tolerance of a range between 0° C. and 4.5° C., including any subranges and any individual temperatures falling with that range. For example, other embodiments can optionally maintain the cool temperature within the fresh food compartment 14 within a reasonably close tolerance of a temperature between 0.25° C. and 4° C.

Figure 3:
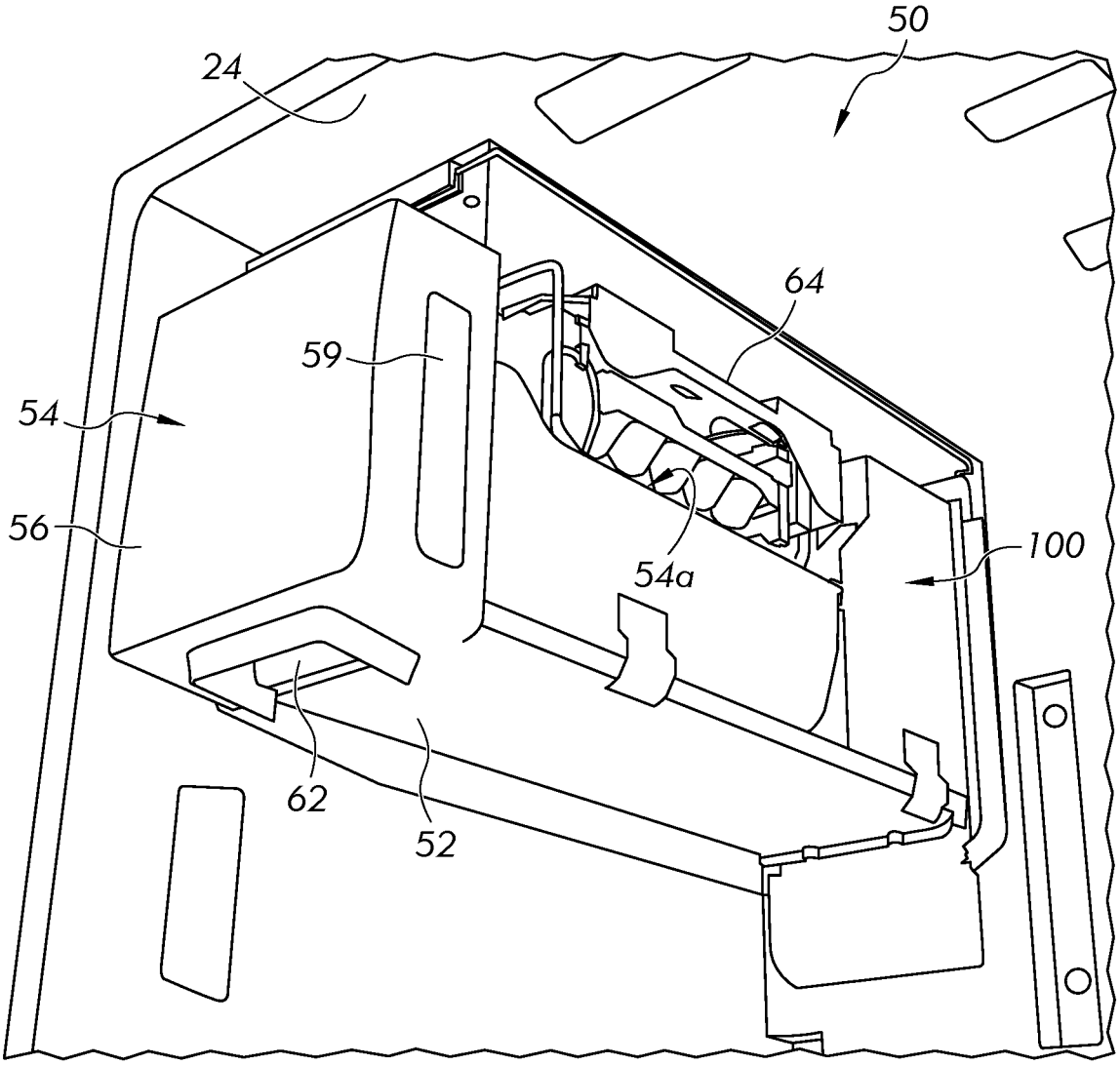
FIG. 3 is a side perspective view of an ice maker with a side wall of a frame of the ice maker removed.

An illustrative embodiment of the ice maker 50 is shown in FIG. 3. In general, the ice maker 50 includes a frame 52, an ice tray 64, an ice bin 54 that stores ice pieces made by the ice tray 64, an evaporator/defrost assembly inside an air handler assembly 100 for providing cooled air and circulating the cooled air to the ice tray 64 and the ice bin 54. The ice maker 50 is secured within the fresh food compartment 14 using any suitable fastener. The frame 52 is generally rectangular in shape for receiving the ice bin 54. The frame 52 includes insulated walls for thermally isolating the ice maker 50 from the fresh food compartment 14. As illustrated in FIG. 3, the side wall of the frame 52 has been removed for clarity so that the interior components are visible. A plurality of fasteners (not shown) may be used for securing the frame 52 of the ice maker 50 within the fresh food compartment 14 of the refrigerator 10.

In one example, the ice tray 64 can comprise a twist-tray type, in which the ice tray 64 is rotated upside down and twisted along its longitudinal axis to thereby break the frozen ice pieces free from the ice reservoirs of the ice tray 64 where they fall into the ice bin 54 located below the ice tray 64. Still, a conventional metal water tray with a plurality of sweeper-arms and a harvest heater for partially melting the ice pieces, or even other types of ice maker assemblies like the finger-evaporator type, could also be utilized.

The ice bin 54 defines a receptacle 54*a* for receiving and storing ice produced by the ice tray 64. The ice bin 54 can optionally be removably installed in the ice maker 50 to grant access to ice pieces stored therein. An aperture 62 formed along a bottom surface of the ice bin 54 is aligned with the aperture leading into the ice chute 22 (FIG. 2) when the door 16 including the dispenser 18 is closed and allows for frozen ice pieces stored therein to be conveyed to the ice chute 22 and dispensed by the dispenser 18.

Figure 4A:
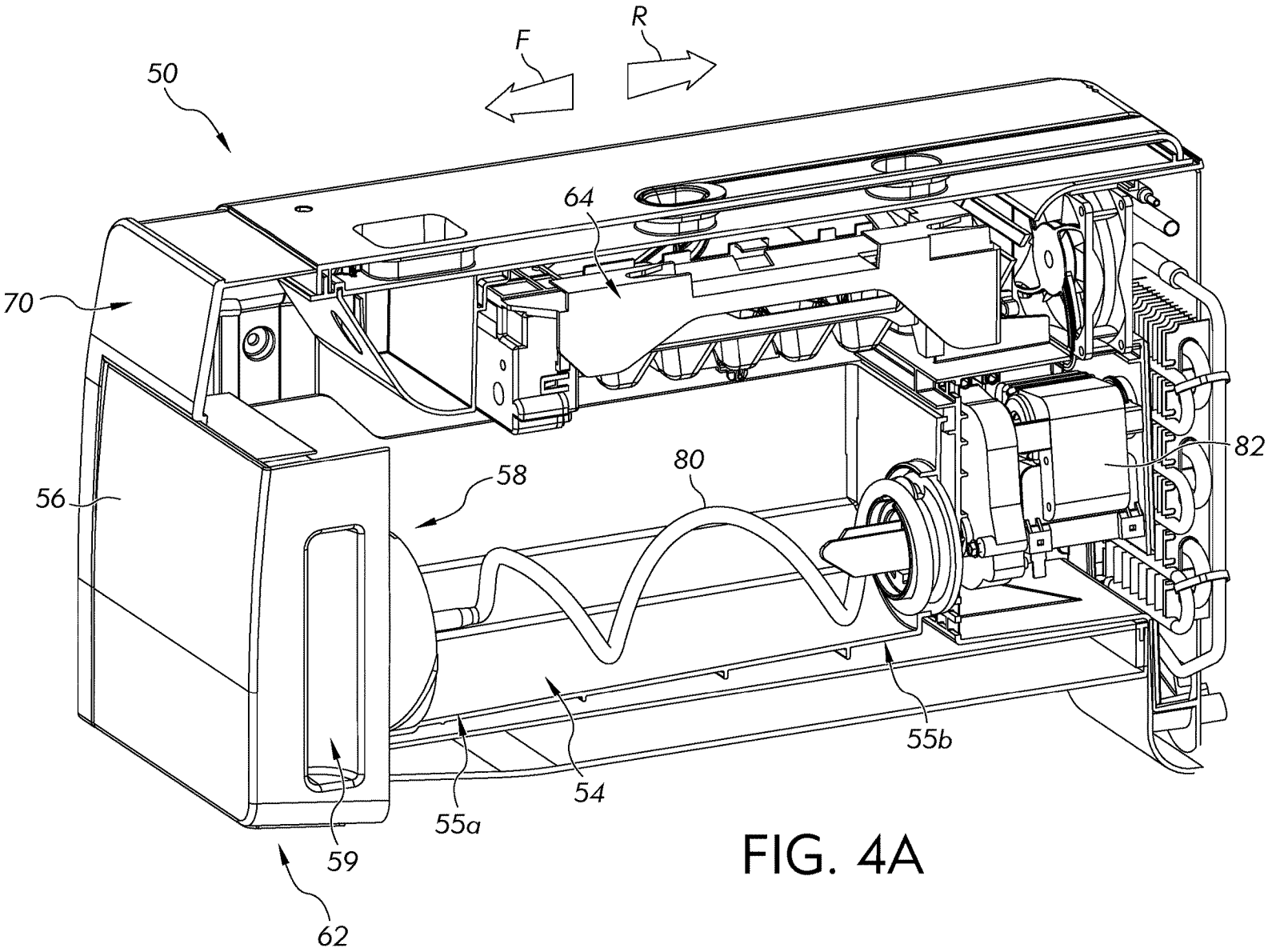
FIG. 4A is a perspective, partial-sectional view of an example ice maker.

Referring to FIG. 4A, the ice bin 54 can include a front cover 56 that is configured to mate with the ice maker chamber 70 to provide a front closure for the ice maker 50. As illustrated in FIG. 4A, portions of the walls of the ice maker chamber 70 have been removed for clarity so that the interior components are visible. Preferably, the ice bin 54 is removable from the ice maker chamber 70 to provide a user with access to the ice stored therein. The front cover 56 can include a hand grip recess 59 or the like to enable a user to remove the ice bin 54 from the ice maker chamber 70. In one example, the ice bin 54 can be slidably received within the ice maker chamber 70, and can be selectively removed therefrom by a user pulling outwards via the hand grip recess 59 to slide the ice bin 54 out of the ice maker chamber 70. The ice bin 54 can be partially or completely removed.

FIG. 4A illustrates a conventional rotatable auger 80 that can extend along a length of the ice bin 54 between a front end 55*a* and a rear end 55*b* of the ice bin 54. The auger 80 is positioned within the ice bin 54 and is configured to drive the ice pieces out of the ice bin 54 via a driving force F applied in a first direction. The rotatable auger 80 is driven by a motor 82 or the like, either directly or indirectly through a transmission and via a removable mechanical coupling (not shown) that permits removal of the ice bin 54 from the ice maker chamber 70 without removal of the motor 82. As part of the ice dispensing function, the auger 80 inside the ice bin 54 is rotated to push ice toward the front end 55*a* of the ice bin 54 via the driving force F so that the ice can be dispensed via the aperture 62 formed along the bottom surface of the ice bin 54 and transported to the ice chute 22 and dispenser 18. In order for ice to dispense properly, the auger 80 pushes the ice forward to the aperture 62 at a slightly higher rate than the ice actually passes through the aperture 62. In doing so, at least a portion of the driving force F is applied against an inside wall 58 towards the front end 55*a* of the ice bin 54. This force, along with any vibration created during dispensing, tends to push the ice bin 54 out of the ice maker chamber 70. Conventional ice makers may use latches to secure the ice bin 54 in the ice maker chamber 70 to hinder the ice bin 54 from being pushed out of the ice maker chamber 70.

Figure 4B:
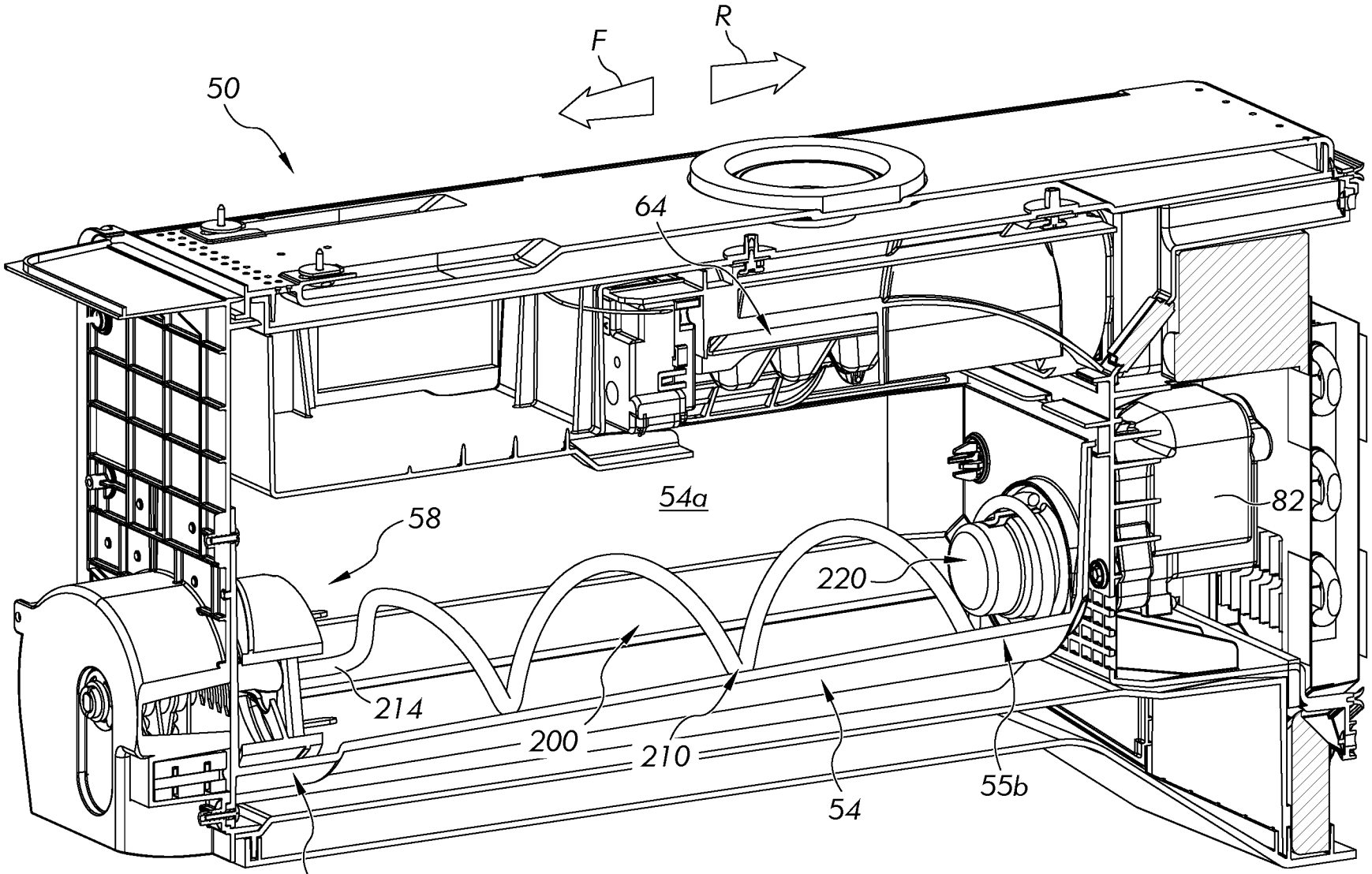
FIG. 4B is a perspective, partial-sectional view of an ice maker with an auger assembly according to an embodiment of the present invention.
Figure 5:
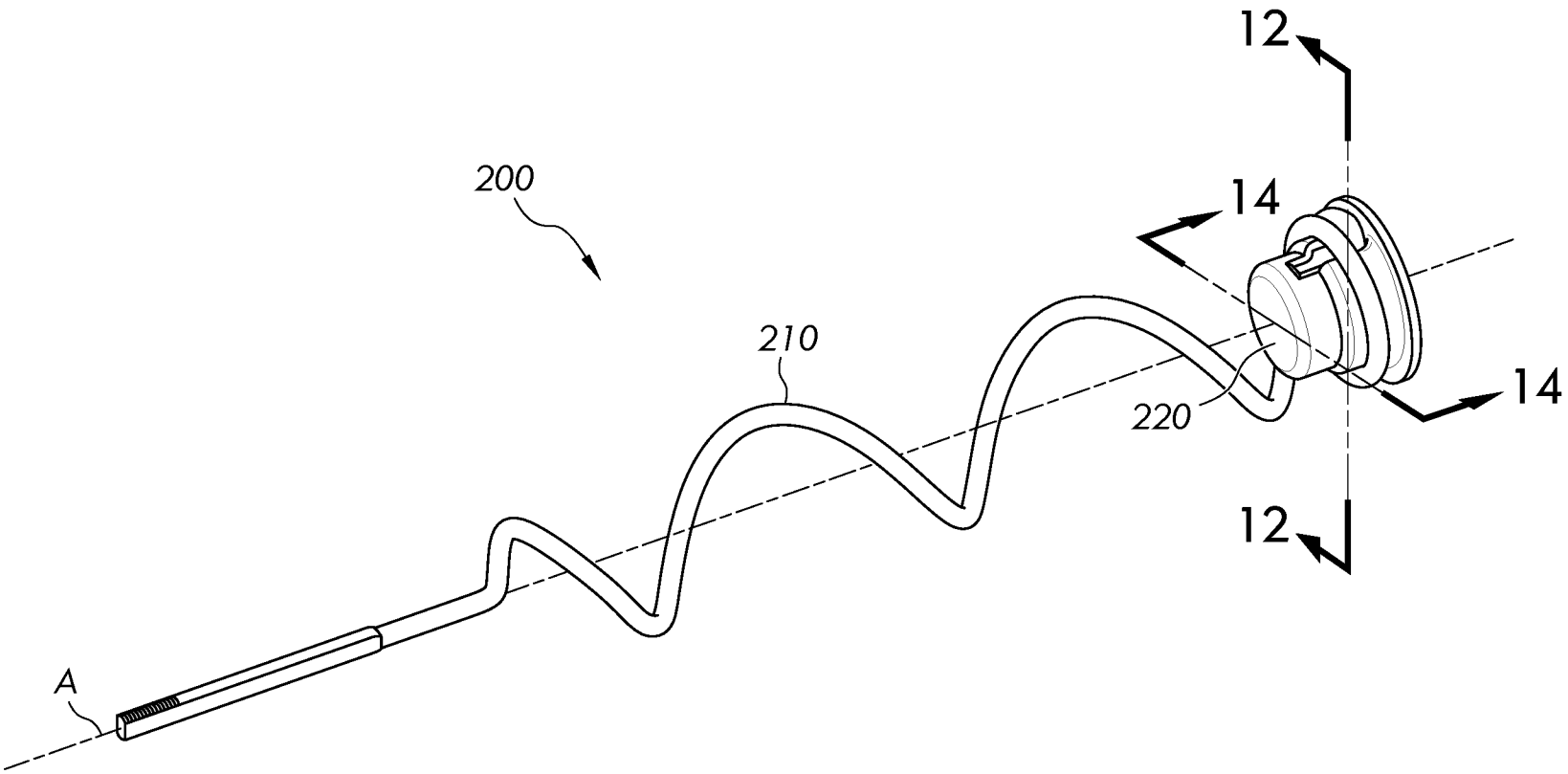
FIG. 5 is a perspective view of the auger assembly of FIG. 4B.

Referring to FIG. 4B, the present application replaces the conventional auger 80 (FIG. 4A) with an auger assembly 200. The auger assembly 200 includes, in general, an auger 210, a cam 220 and a drive bar 240 (FIG. 6) that is connected to the motor 82.

Figure 6:
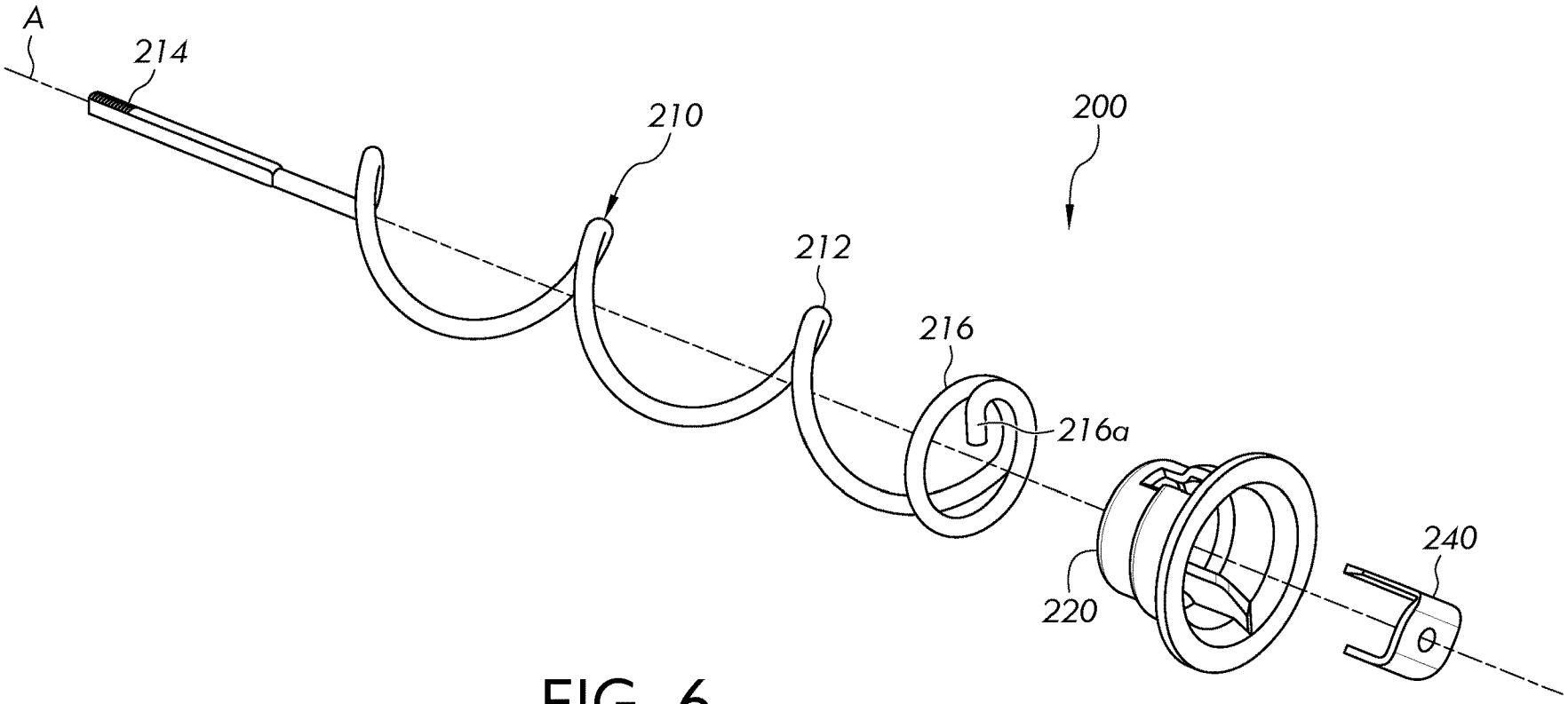
FIG. 6 is a rear exploded view of the auger assembly of FIG. 5.

Referring to FIG. 6, the auger 210 includes a helical-shaped body portion 212, a keyed first end 214 and a second end 216. The keyed first end 214 is configured to engage a slot (not shown) formed in the front end 55*a* of the ice bin 54 (FIG. 4B) and which is configured to engage with and drive a conventional ice crusher mechanism (not shown). The second end 216 of the auger 210 is curved in a tight spiral and terminates at a distal tip 216*a* that extends inwardly toward a central axis A of the auger 210 for engagement with the cam 220, as described in detail below.

Figure 8:
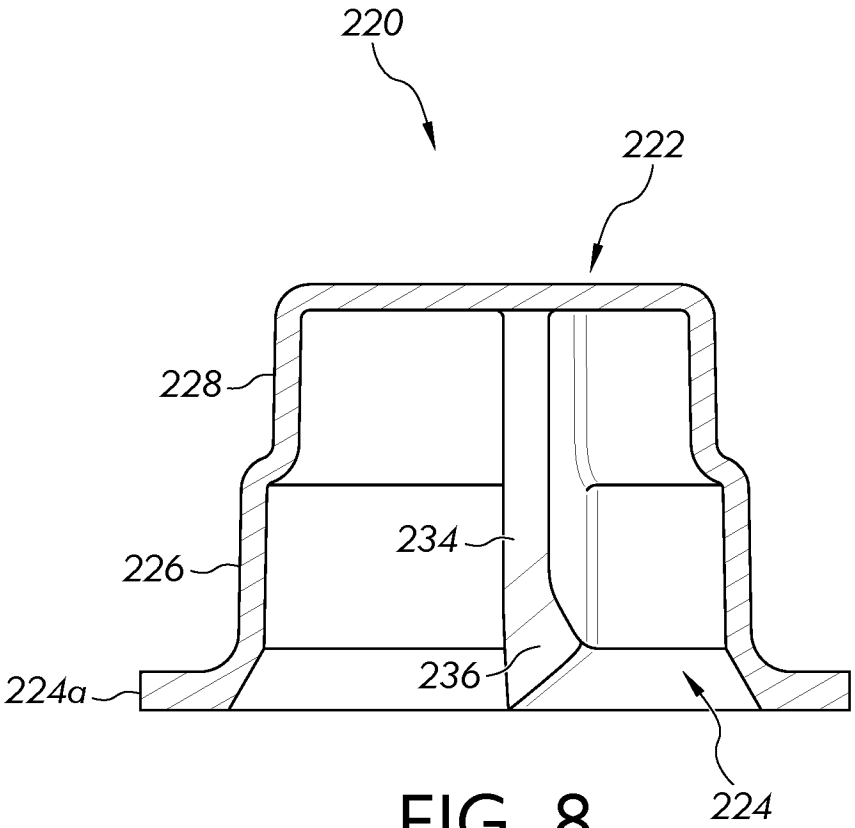
FIG. 8 is sectional view taken along line 8-8 of FIG. 7.
Figure 7:
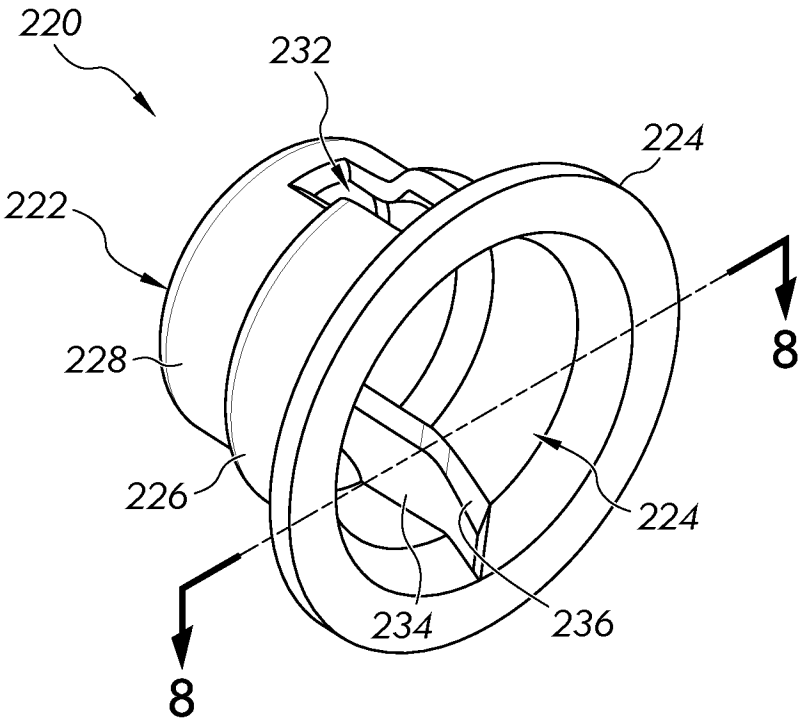
FIG. 7 is a perspective view of a cam of the auger assembly of FIG. 6.

Referring to FIGS. 7 and 8, the cam 220 is a hat-shaped body having a closed first end 222 and an open second end 224. The cam 220 is formed such that a first portion 226 of the body toward the open second end 224 has a larger diameter than a second portion 228 of the body. A flange 224*a* extends outwardly from a periphery of the open second end 224.

A slot 232 is formed in a side wall of the cam 220 in the first portion 226 and the second portion 228. The slot 232 is dimensioned to allow the distal tip 216*a* of the auger 210 to extend into an inner cavity of the cam 220, as described in detail below.

A protrusion 234 extends axially along an inner wall of the body of the cam 220. The protrusion 234 includes a ramp portion 236 that is configured to engage the drive bar 240, as described in detail below.

Figure 10:
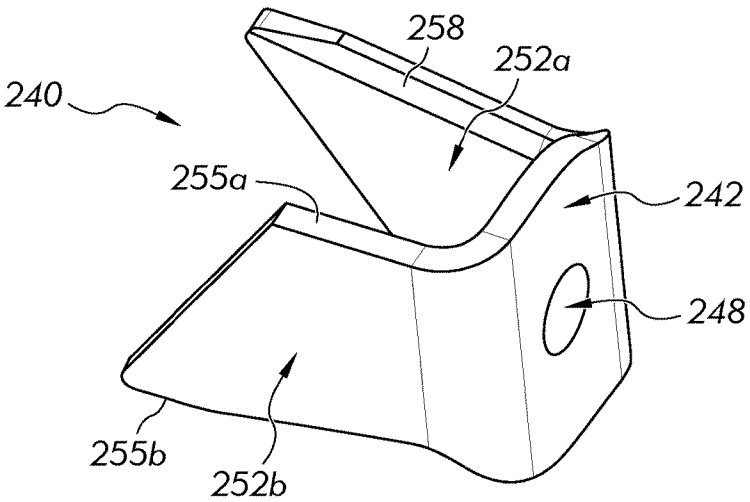
FIG. 10 is a rear perspective view of the drive bar of FIG. 9.
Figure 11:
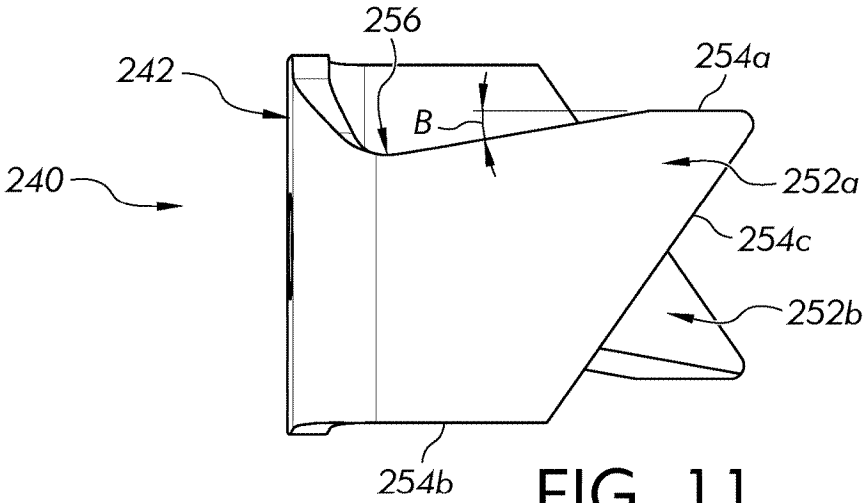
FIG. 11 is a side view of the drive bar of FIG. 9.
Figure 9:
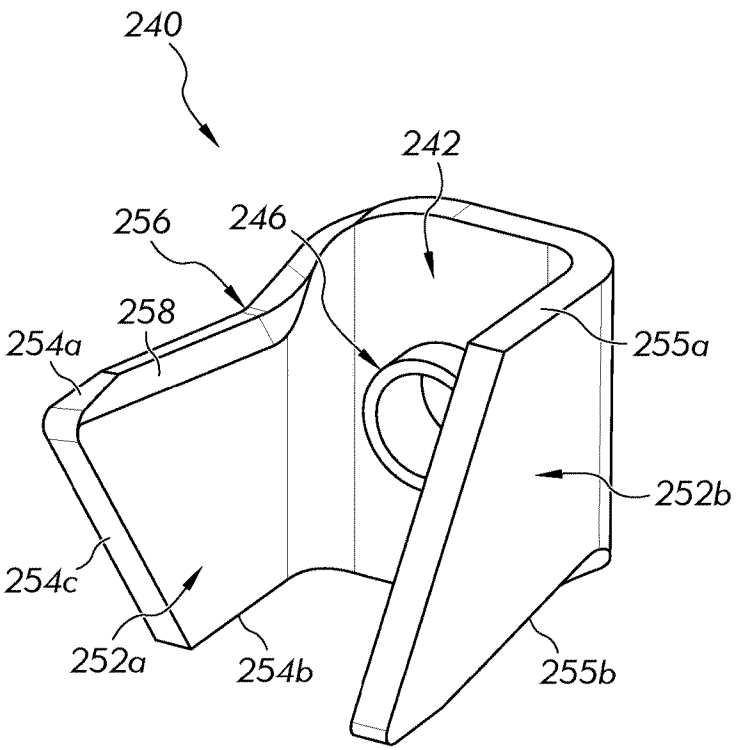
FIG. 9 is a front perspective view of a drive bar of the auger assembly of FIG. 6.

Referring to FIGS. 9-11, the drive bar 240 is illustrated. The drive bar 240 is a generally U-shaped element having a central portion 242 and legs 252*a*, 252*b* extending from opposite ends of the central portion 242. In the embodiment illustrated, the legs 252*a*, 252*b* extend perpendicularly from the central portion 242.

A bushing 246 is attached to an inner wall of the central portion 242 and is dimensioned to be in registry with an opening 248 in the central portion 242. The bushing 246 and the opening 248 define an engagement feature for securing the drive bar 240 to the motor 82 (either directly or via an intermediary gearbox) for rotation of the drive bar 240.

Referring to FIG. 11, the leg 252*a* will be described in detail, the description of which also applies to leg 252*b*. The leg 252*a* includes a long upper side 254*a* and a short lower side 254*b* that are connected by an angled side 254*c*. The angled side 254*c* defines a distal end of the leg 252*a* that functions as an engagement surface of the leg 252*a*, as described in detail below.

Figure 14:
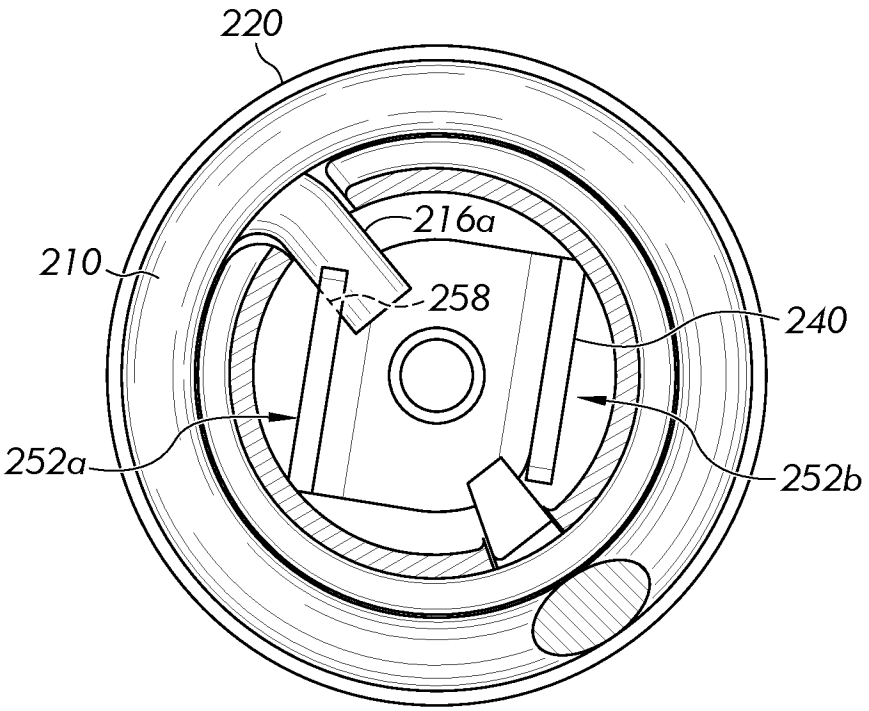
FIG. 14 is a sectional view taken along line 14-14 of FIG. 5.

A recess 256 is formed in the long upper side 254*a* proximate the end of the leg 252*a* that engages the central portion 242. In the embodiment illustrated, the recess 256 is formed as a sloped surface that is angled B degrees relative to horizontal. It is contemplated that B may be about 7 to about 20 degrees, preferably about 15 degrees. It is also contemplated that the recess 256 may be other shapes, e.g., curved, so long as the recess 256 is below the remaining portion of the long upper side 254*a*. That is, as shown in FIGS. 11 and 14, the recess 256 is provided as a pocket or receding space that at least partially receives the distal tip 216*a* of the auger below the long upper side 254*a*.

Referring to FIGS. 9 and 10, a chamfered surface 258 is formed along an inner edge of the long upper side 254*a*. The chamfered surface 258 is illustrated as extending along the entire inner edge of the long upper side 254*a*. It is contemplated that the chamfered surface 258 may be formed only on the portion of the inner edge that is proximate the central portion 242 wherein the leg 252*a* attaches. The chamfered surface 258 has an angle that is configured to match the distal tip 216*a* of the auger 210, as described below.

Figure 13:
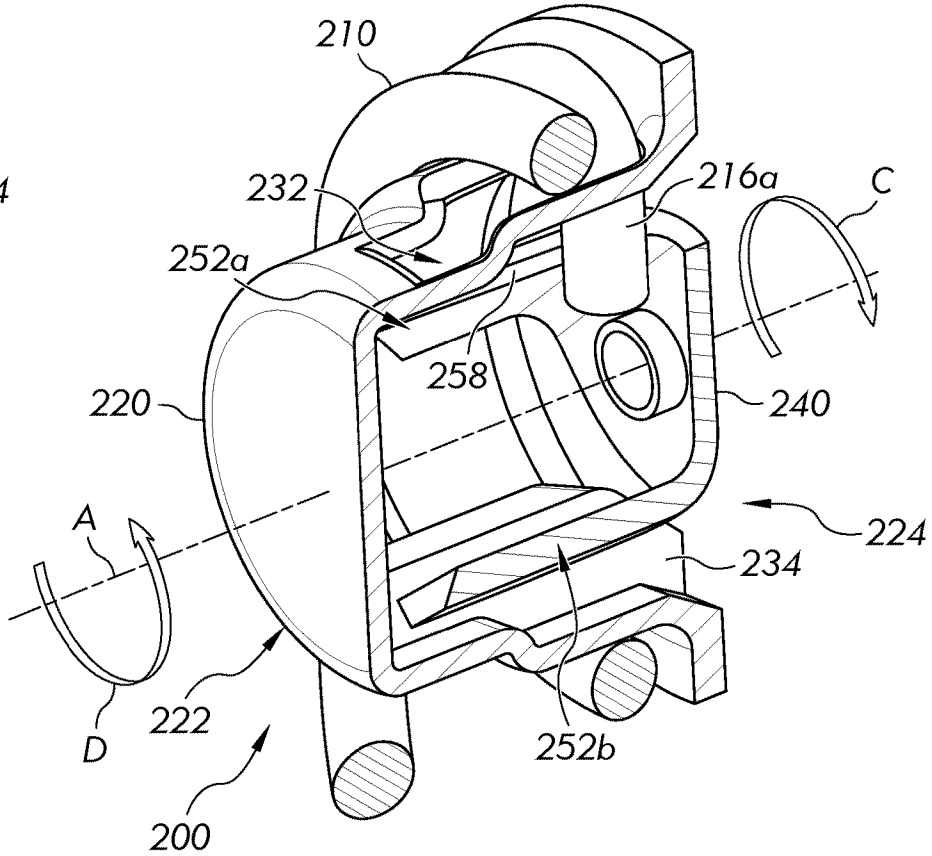
FIG. 13 is a sectional view taken along line 12-12 of FIG. 5.
Figure 12:
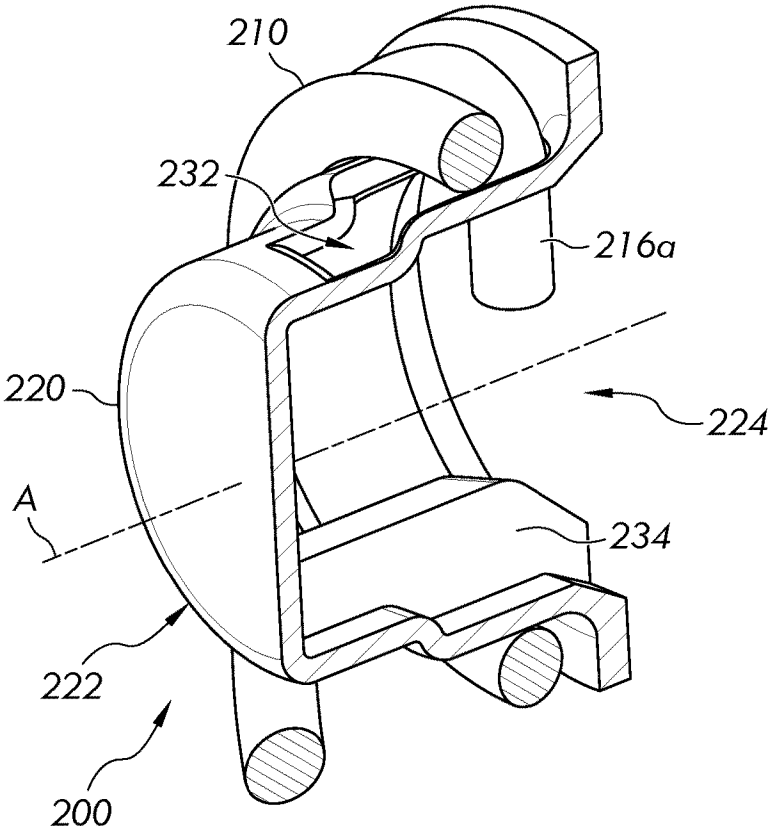
FIG. 12 is a sectional view taken along line 12-12 of FIG. 5 with the drive bar removed.

The leg 252*b* is similar to the leg 252*a*, as described above, except the leg 252*a* includes a short upper side 255*a* and a long lower side 255*b*, i.e., opposite the long upper side 254*a* and the short lower side 254*b* of the leg 252*a*, as illustrated in FIG. 13. Scary Referring to FIG. 4B, the auger assembly 200 is positioned in the receptacle 54*a* of the ice bin 54 to replace the conventional auger 80 (FIG. 4A). In particular, the first end 214 of the auger 210 engages the inside wall 58 of the ice bin 54 and extends toward the rear end 55*b* of the ice bin 54. The cam 220 is positioned on the rear end 55*b* of the ice bin 54. Referring to FIG. 12, the distal tip 216*a* of the auger 210 extends into the slot 232 formed in the cam 220 such that the distal tip 216*a* extends into the inner cavity of the cam 220.

Referring to FIG. 13, as the ice bin 54 is inserted rearwardly into the ice maker chamber 70, the drive bar 240, which is attached to a drive shaft of the motor 82 (not shown for clarity) is received into the open second end 224 of the cam 220. In particular, the legs 252*a*, 252*b* of the drive bar 240 are first received into the open second end 224. When properly aligned, the distal tip 216*a* of the auger 210 will be positioned adjacent the long upper side 254*a* of the leg 252*a*, as illustrated in FIG. 14. A similar positioning of the drive bar 240 will be achieved if the distal tip 216*a* is positioned adjacent the long lower side 255*b* of the leg 252*b* (not shown).

Rotation of the drive bar 240 in the direction C, i.e., in the clockwise direction when viewed from closed first end 222 of the cam 220, causes the long upper side 254*a* of the leg 252*a* to engage the distal tip 216*a*. In particular, as illustrated in FIG. 14, the distal tip 216*a* engages the recess 256 and the chamfered surface 258 formed in the long upper side 254*a*. The chamfered surface 258 is angled to match the surface of the distal tip 216*a* to provide a large contact surface between the distal tip 216*a* and the drive bar 240. This facilitates the transmission of torque from the drive bar 240 to the auger 210 and also helps to prevent denting or scratching of the drive bar 240 over time. Excessive denting or scratching of the drive bar 240 may lead to a reduction in the effectiveness of the locking function of the drive bar 240.

The recess 256 in the drive bar 240 is configured so that rotation of the drive bar 240 imparts little or no force in the direction of the driving force F (FIG. 4B) but, instead, the force is directed in the rear direction R (FIG. 4B). By directing the application of force in the rear direction R, the drive bar 240 reduces or eliminates the movement of the ice bin 54 out of the ice maker chamber 70 during rotation of the auger 210. The angle and/or shape of the recess 256 also provides resistance that a user must overcome in order to remove the ice bin 54 from the ice maker chamber 70. Therefore, the angle and/or shape of the recess 256 is selected to create a force of sufficient magnitude to retain the ice bin 54 in the ice maker chamber 70 during ice dispensing but that is low enough that a user can still remove the ice bin 54 when desired. At a minimum, the angle and/or shape of the recess 256 is selected to create a force of sufficient magnitude to resist the driving force F applied in a first direction by rotation of the auger 210.

Figure 15:
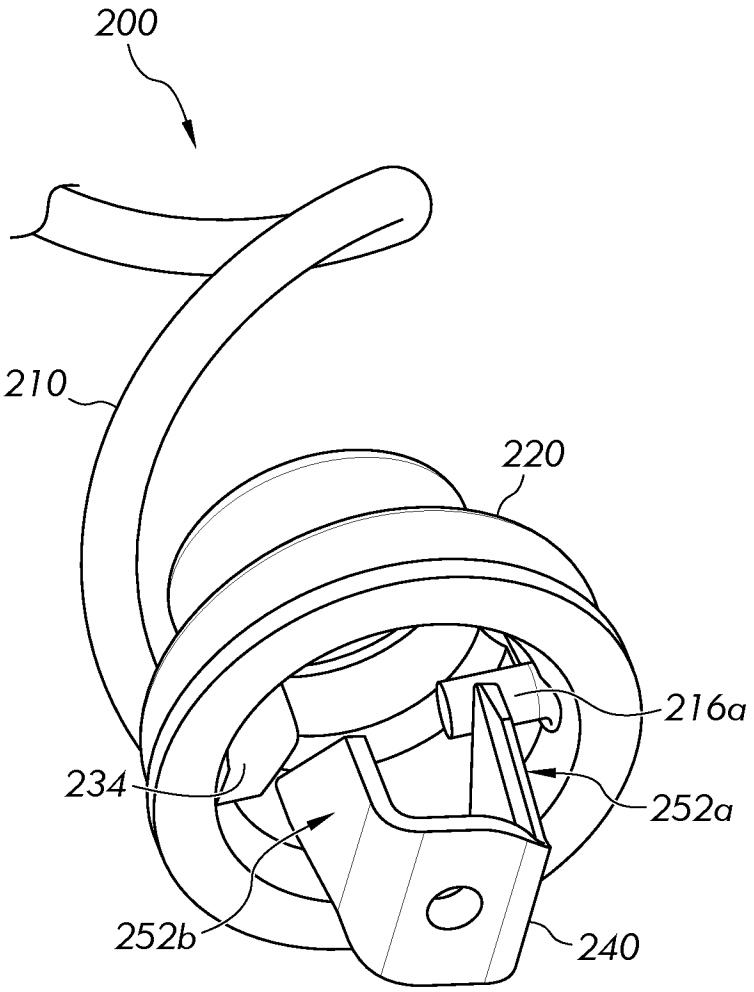
FIG. 15 is a rear partially exploded view of the auger assembly of FIG. 5 showing the drive bar during insertion into the cam of the auger assembly.

In the event the distal tip 216*a* of the auger 210 is not properly aligned with the drive bar 240 (see, FIG. 15), the angled side 254*c* of the drive bar 240 will engage the ramp portion 236 of the protrusion 234 in the cam 220 or the distal tip 216*a* of the auger 210 as the ice bin 54 is inserted into the ice maker chamber 70. This engagement causes the auger 210 and cam 220 to rotate in the counter-clockwise direction D (FIG. 13) when viewed from closed first end of the cam 220. The rotation of the auger 210 and the cam 220 positions the distal tip 216*a* of the auger 210 on the correct side of the respective leg 252*a*, 252*b*.

An additional benefit of the configuration of the drive bar 240 is that it provides an anti-twist function to the ice bin 54. During ice crushing using an ice crusher device (not shown) that can be driven by the keyed first end 214 of the auger 210, the ice bin 54 experiences a torsional force T along its length that is related to, such as equal to, the force required to crush the ice. The ice bin 54 may not have the torsional strength to resist this force without twisting excessively. Consequently, ice bins typically have a rigid pin inserted through their back wall in a position that counteracts the twisting torsional force. The drive bar 240 of the instant application can similarly provide the functionality of the conventional anti-twist pin while also retaining the ice bin 54 within the ice maker chamber 70. For example, while the auger 210 can be located generally centrally within the ice bin 54, the legs 252*a*, 252*b* of the drive bar 240 can be laterally offset from a central longitudinal axis of the ice bin 54 to thereby provide increased mechanical advantage for resisting the torsional forces applied to the ice bin 54.

The drive bar 240 described herein can provide additional features. In addition to the ice bin 54 retention functionality, the drive bar 240 eliminates the need for latches and anti-twits pins so that the ice bin will need fewer parts and have a clean appearance. Additionally, the drive bar 240 does not require the user to press or push any buttons, levers, or similar things to release the ice bin 54 so it can be removed. Instead, the user simply has to pull on the ice bin 54 with enough removal force to overcome retention of the auger 210 in the recess 256 of the drive bar 240 to be able to remove the ice bin 54.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A refrigeration appliance comprising:

a fresh food compartment for storing food items in a refrigerated environment having a target temperature above zero degrees Centigrade;

a freezer compartment for storing food items in a sub-freezing environment having a target temperature below zero degrees Centigrade;

an ice maker disposed within the fresh food compartment or the freezer compartment for freezing water into ice pieces, the ice maker comprising a removable ice bin for storing the ice pieces produced by the ice maker;

a rotatable auger positioned within the removable ice bin and configured to drive the ice pieces out of the removable ice bin via a driving force applied in a first direction;

a motor configured to rotate the auger; and a drive bar coupled to the motor and engageable with the rotatable auger, the drive bar configured to apply a resisting force to the removable ice bin along a second direction generally opposed to the first direction sufficient to counteract the driving force, wherein the resisting force is less than a removal force applied by a user to remove the removable ice bin from the ice maker.

2. The refrigeration appliance of claim 1, wherein the drive bar comprises at least one leg having a recess formed in a surface thereof for engaging the rotatable auger.

3. The refrigeration appliance of claim 1, wherein the drive bar comprises at least one leg having a chamfered surface for engaging the rotatable auger.

4. The refrigeration appliance of claim 1, wherein the drive bar comprises at least one leg with an engagement surface for engaging the rotatable auger during insertion of the removable ice bin into the ice maker.

5. The refrigeration appliance of claim 1, further comprising a cam disposed between the rotatable auger and the drive bar, the cam comprising a slot in a side wall thereof for receiving a distal end of the rotatable auger.

6. The refrigeration appliance of claim 5, wherein the drive bar comprises at least one leg with an engagement surface for engaging a protrusion formed on an inner wall of the cam during insertion of the removable ice bin into the ice maker.

7. The refrigeration appliance of claim 1, wherein the drive bar comprises a U-shaped body having two legs, each of said two legs comprising a recess formed in a surface thereof for engaging the rotatable auger.

8. The refrigeration appliance of claim 1, wherein the drive bar comprises a U-shaped body having two legs, each of said two legs comprising a chamfered surface for engaging the rotatable auger.

9. The refrigeration appliance of claim 1, wherein at least one leg of the drive bar provides the resisting force sufficient to counteract the driving force of the rotatable auger.

10. The refrigeration appliance of claim 1, wherein the freezer compartment is disposed at an elevation vertically below the fresh food compartment.

11. The refrigeration appliance of claim 1, wherein the freezer compartment is disposed laterally next to the fresh food compartment.

* * * * *